US011798504B2

(12) United States Patent
He

(10) Patent No.: US 11,798,504 B2
(45) Date of Patent: Oct. 24, 2023

(54) AMBIENT LIGHT DETECTION METHOD AND ELECTRONIC DEVICE

(71) Applicant: VIVO MOBILE COMMUNICATION CO., LTD., Guangdong (CN)

(72) Inventor: Yifan He, Guangdong (CN)

(73) Assignee: VIVO MOBILE COMMUNICATION CO., LTD., Guangdong (CN)

( * ) Notice: Subject to any disclaimer, the term of this patent is extended or adjusted under 35 U.S.C. 154(b) by 0 days.

(21) Appl. No.: 17/989,524

(22) Filed: Nov. 17, 2022

(65) Prior Publication Data

US 2023/0087988 A1 Mar. 23, 2023

Related U.S. Application Data

(63) Continuation of application No. PCT/CN2021/093276, filed on May 12, 2021.

(30) Foreign Application Priority Data

May 18, 2020 (CN) ..... 202010421239.1

(51) Int. Cl.
*G09G 3/34* (2006.01)
*G09G 5/10* (2006.01)

(52) U.S. Cl.
CPC ..... *G09G 3/3406* (2013.01); *G09G 5/10* (2013.01); *G09G 2320/0233* (2013.01); *G09G 2320/0626* (2013.01); *G09G 2360/144* (2013.01)

(58) Field of Classification Search
CPC ..... G09G 2360/144; G09G 3/3406; G09G 3/3648
See application file for complete search history.

(56) References Cited

U.S. PATENT DOCUMENTS 5,847,795 A * 12/1998 Satoh ..... G02B 1/11 349/137
2008/0152192 A1* 6/2008 Zhu ..... G06V 10/147 382/103
2008/0203279 A1* 8/2008 Kobashi ..... H01J 29/96 250/216

(Continued)

FOREIGN PATENT DOCUMENTS

CN 101211538 A 7/2008
CN 103137099 A 6/2013

(Continued)

OTHER PUBLICATIONS

First Office Action for Chinese Application No. 202010421239.1, dated Jan. 6, 2021, 10 Pages.

(Continued)

*Primary Examiner* — Van N Chow
(74) *Attorney, Agent, or Firm* — BROOKS KUSHMAN P.C.

(57) ABSTRACT

An ambient light detection method and an electronic device. The method includes: when a target pixel in a target display area of a display module is lit up, obtaining a first brightness value of each target pixel collected by a photosensitive sensor; according to the first brightness value, obtaining a brightness interference value of each target pixel; and according to the brightness interference value and a first ambient light brightness value, obtaining a target brightness value.

15 Claims, 3 Drawing Sheets

(56) References Cited

U.S. PATENT DOCUMENTS

| | | | | |
|---|---|---|---|---|
| 2013/0329052 | A1* | 12/2013 | Chew | G06T 7/0008 348/159 |
| 2014/0146164 | A1* | 5/2014 | Bajema | H04N 17/002 348/89 |
| 2016/0330414 | A1* | 11/2016 | Takado | H04N 25/77 |
| 2018/0348049 | A1* | 12/2018 | Yoon | G09G 3/3406 |
| 2022/0292645 | A1* | 9/2022 | Li | G06T 7/0004 |
| 2023/0087988 | A1* | 3/2023 | He | G09G 3/20 345/77 |
| 2023/0154025 | A1* | 5/2023 | Ji | G06T 7/12 382/106 |

FOREIGN PATENT DOCUMENTS

| | | | |
|---|---|---|---|
| CN | 107818753 | A | 3/2018 |
| CN | 107945769 | A | 4/2018 |
| CN | 111613176 | A | 9/2020 |

OTHER PUBLICATIONS

International Search Report and Written Opinion for Application No. PCT/CN2021/093276, dated Aug. 2, 2021, 9 Pages.

* cited by examiner

AMBIENT LIGHT DETECTION METHOD AND ELECTRONIC DEVICE

CROSS-REFERENCE TO RELATED APPLICATIONS

This application is a continuation of International Application No. PCT/CN2021/093276 filed on May 12, 2021, which claims priority to Chinese Patent Application No. 202010421239.1 filed on May 18, 2020, which are incorporated herein by reference in their entireties.

TECHNICAL FIELD

The present invention relates to the field of information processing technologies, and in particular, to an ambient light detection method and an electronic device.

BACKGROUND

To reduce an impact of a screen of an electronic device on a user's vision, it is necessary to adjust brightness of a display module of the electronic device when ambient brightness changes. For example, the brightness of the display module is decreased in a low brightness environment, and the brightness of the display module is increased in a high brightness environment.

In the prior art, to increase a screen-to-body ratio of the electronic device, a photosensitive sensor for detecting ambient light brightness is placed below the display module, and screen backlight is adjusted according to an ambient light brightness value detected by the photosensitive sensor to adjust the brightness of the display module.

However, due to interference of screen light, the detected ambient light brightness value is not accurate enough.

SUMMARY

Embodiments of the present invention provide an ambient light detection method and an electronic device to resolve a problem that a detected ambient light brightness value is not accurate enough due to interference of screen light in the prior art.

To resolve the foregoing technical problem, the present invention is implemented as follows.

According to a first aspect, an embodiment of the present invention provides an ambient light detection method. The method is applied to an electronic device. The electronic device includes a photosensitive sensor, and a glass cover and a display module that are stacked in sequence, where the photosensitive sensor is disposed on a side of the display module away from the glass cover. The method includes:

when a target pixel in a target display area of the display module is lit up, obtaining a first brightness value of each target pixel collected by the photosensitive sensor;

according to the first brightness value, obtaining a brightness interference value of each target pixel; and according to the brightness interference value and a first ambient light brightness value, obtaining a target brightness value.

The first ambient light brightness value is a brightness value collected by the photosensitive sensor under a first ambient light.

According to a second aspect, an embodiment of the present invention provides an electronic device, and the electronic device includes:

an obtaining module, configured to, when a target pixel in a target display area of the display module is lit up, obtain a first brightness value of each target pixel collected by the photosensitive sensor;

a brightness interference value obtaining module, configured to, according to the first brightness value, obtain a brightness interference value of each target pixel; and a target brightness value obtaining module, configured to, according to the brightness interference value and a first ambient light brightness value, obtain a target brightness value, where the first ambient light brightness value is a brightness value collected by the photosensitive sensor under a first ambient light.

According to a third aspect, an embodiment of the present invention further provides an electronic device, including a memory, a processor, and a computer program stored in the memory and capable of running on the processor, where when the computer program is executed by the processor, the steps of the foregoing ambient light detection method are implemented.

According to a fourth aspect, an embodiment of the present invention provides a computer-readable storage medium, where the computer-readable storage medium stores a computer program, and when the computer program is executed by a processor, the steps of the foregoing ambient light detection method are implemented.

In the embodiments of the present invention, when a target pixel in a target display area of a display module is lit up, a first brightness value of each target pixel collected by a photosensitive sensor is obtained; according to the first brightness value, a brightness interference value of each target pixel is obtained; and according to the brightness interference value and a first ambient light brightness value, a target brightness value is obtained. The target brightness value is obtained according to the brightness interference value and the first ambient light brightness value, thereby improving accuracy of the obtained ambient light brightness value.

BRIEF DESCRIPTION OF DRAWINGS

To describe the technical solutions of the embodiments of the present invention more clearly, the following briefly describes the accompanying drawings required for describing the embodiments of the present invention. Apparently, the accompanying drawings in the following description show merely some embodiments of the present invention, and a person of ordinary skill in the art may still derive other drawings from these accompanying drawings without creative efforts.

DETAILED DESCRIPTION

The following clearly and completely describes the technical solutions in the embodiments of the present invention with reference to the accompanying drawings in the embodiments of the present invention. Apparently, the described embodiments are some rather than all of the embodiments of the present invention. All other embodiments obtained by a person of ordinary skill in the art according to the embodiments of the present invention without creative efforts shall fall within the protection scope of the present invention.

Figure 1:
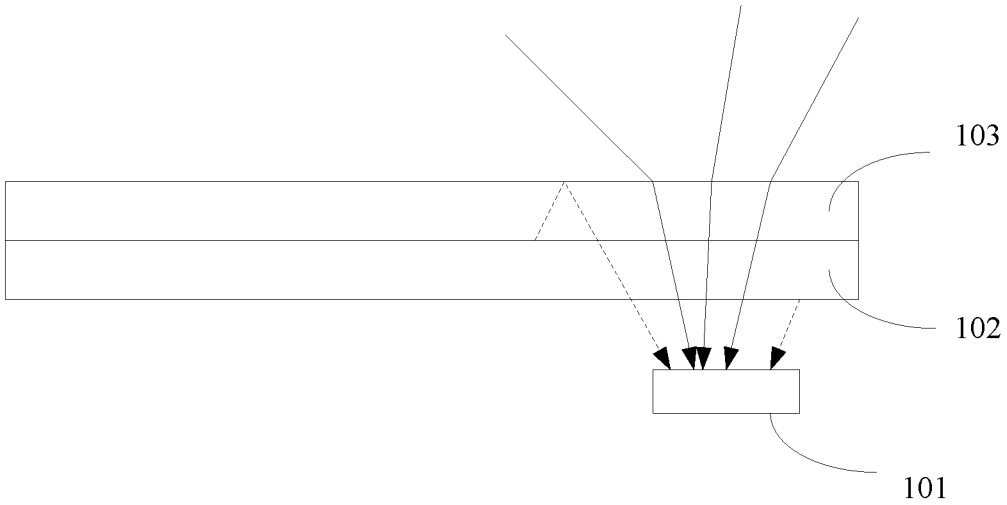
FIG. 1 is a schematic structural diagram of an under-screen photosensitive sensor according to an embodiment of the present invention.

FIG. 1 is a schematic structural diagram of an under-screen photosensitive sensor according to an embodiment of the present invention. In an electronic device, a photosensitive sensor 101 is disposed below a display module 102 with light transmittance. The display module 102 includes, for example, a screen. The display module 102 may be an active-matrix organic light-emitting diode (Active-matrix organic light-emitting diode, AMOLED) display screen. A display area of the AMOLED display screen has certain light transmittance. The photosensitive sensor 101 may be disposed at any projection position on the back of the display module 102. By analogy, the photosensitive sensor 101 may be welded on a printed circuit board (Printed Circuit Board, PCB), to be specific, the photosensitive sensor 101 is fastened on the back of the display module 102, so as to ensure a high screen-to-body ratio of the electronic device. The whole photosensitive sensor 101 is limited to a fixed position by an overall structure, and a specific position depends on a stacking solution.

As shown in FIG. 1, light received by the photosensitive sensor 101 disposed below the display module 102 is divided into two categories: one category is actual ambient light represented by a solid line, and the other category is screen light represented by dotted lines (the screen light is interference light). The screen light comes from scattering of light of a display content of the display module 102 and reflection of light of a glass cover 103. In addition, the ambient light brightness value obtained by the photosensitive sensor 101 includes an actual ambient light brightness value and a screen light brightness value. In the prior art, the ambient light brightness value obtained by the photosensitive sensor 101 is directly taken as the ambient light brightness value. Therefore, the obtained ambient light brightness value includes the screen light brightness value, so that the obtained ambient light brightness value is not accurate enough, to be specific, an error between the detected ambient light brightness value and the actual ambient light brightness value is large.

Figure 2:
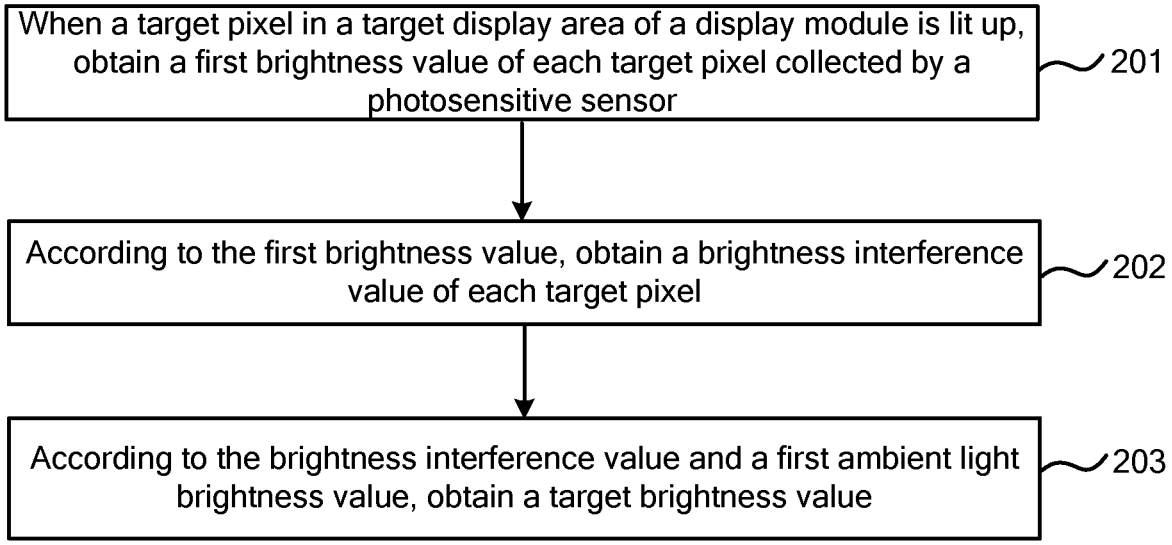
FIG. 2 is a flowchart of steps of an ambient light detection method according to an embodiment of the present invention.

To resolve the foregoing technical problem, interference of the screen light on the actual ambient light detected by the photosensitive sensor is considered in the embodiments of the present invention, so that the obtained target brightness value is closer to the actual ambient light brightness value. Specifically, FIG. 2 is a flowchart of steps of an ambient light detection method according to an embodiment of the present invention. The method is applied to an electronic device. The electronic device includes a photosensitive sensor 101, and a glass cover 103 and a display module 102 that are stacked in sequence. The photosensitive sensor 101 is disposed on a side of the display module 102 away from the glass cover 103, as shown in FIG. 1. As shown in FIG. 2, the ambient light detection method may specifically include the following steps.

Step 201: When a target pixel in a target display area of the display module is lit up, obtain a first brightness value of each target pixel collected by the photosensitive sensor.

A target area may be determined on the display module of the electronic device according to a position of the photosensitive sensor. For example, a pixel on the display module directly opposite center of the photosensitive sensor is used as a center point, and a square array area composed of 22 pixels upward, downward, left, and right of the center point is used as a target area, that is, a 45 pixels×45 pixels area around the center point, a total of 2,025 pixels, is used as the target area. Alternatively, a 30 pixels×30 pixels area around the center point in the square array area, a total of 900 pixels, is used as the target area. The target area may also be an entire area of the screen. According to an experiment, in a case that the target area includes pixels outside the 45 pixels×45 pixels, total 2,025 pixels, square array area, interference of pixels outside the square array area to the detected brightness value is almost zero. Therefore, to reduce calculation workload, an entire screen area may not be used as the target area.

As shown in FIG. 1, an area of the display module directly above the photosensitive sensor 101 is the target area. When target pixels in the target display area are lit up, a first brightness value of each target pixel collected by the photosensitive sensor may be obtained. When all the target pixels in the target display area are lit up, the first brightness value of each target pixel collected by the photosensitive sensor may be obtained. Alternatively, when the target pixels in the target display area are lit up in sequence, the first brightness value of each target pixel collected by the photosensitive sensor is obtained.

It should be noted that when all the target pixels in the target display area are lit up, the first brightness value of each target pixel obtained by the photosensitive sensor is a total brightness value of all the target pixels. For example, when all the target pixels in the target display area are lit up to any of three primary colors of red, green, and blue, the first brightness value of each target pixel may be obtained, so that three first brightness values may be obtained.

Figure 3:
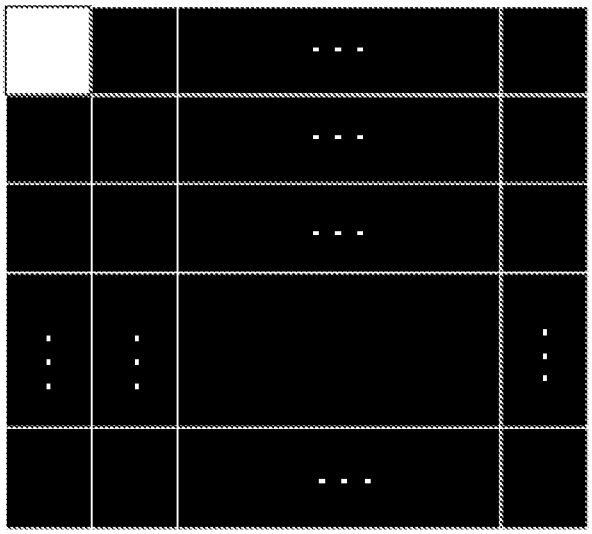
FIG. 3 is a schematic diagram of a target pixel included in a target area according to an embodiment of the present invention.

When the target pixels in the target display area are lit up in sequence, the first brightness value of each target pixel collected by the photosensitive sensor is obtained. For example, it is as shown in FIG. 3. FIG. 3 is a schematic diagram of a target pixel included in a target area according to an embodiment of the present invention. FIG. 3 shows a plurality of target pixels, and one small square represents one target pixel. The target area is split by pixel, and each pixel in the target area is one target pixel. For example, as shown in FIG. 3, when a target pixel A11 in the first row and the first column is lit up, and pixels in the target area other than the target pixel A11 are not lit up (for example, a pixel in the first row and the first column in FIG. 3 is lit up, and the other pixels are not lit up), a first brightness value B11 of the target pixel A11 collected by the photosensitive sensor is obtained. An example in which the target area includes four pixels is used for description. For example, after obtaining the first brightness value B11, a target pixel A12 in the first row and the second column is lit up. When pixels in the target area other than the target pixel A12 are not lit up, a first brightness value B12 of the target pixel A12 collected by the photosensitive sensor is obtained. By analogy, a first brightness value Bij of the target pixel in row i and column j is obtained in sequence.

It should be noted that when each target pixel is lit up in sequence, brightness of the screen backlight is set to be the same.

Step 202: According to the first brightness value, obtain a brightness interference value of each target pixel.

When the first brightness value of each target pixel collected by the photosensitive sensor in step 201 is total brightness values of all target pixels, the brightness interference value of each target pixel is obtained according to the first brightness value. For example, when all the target pixels in the target display area are lit up to red, the obtained first brightness value of each target pixel is 5. When all the target pixels in the target display area are lit up to green, the obtained first brightness value of each target pixel is 3. When all the target pixels in the target display area are lit up to blue, the obtained first brightness value of each target pixel is 4. Using an example in which there are four target pixels in the target area, under a first ambient light, the target pixel A11 displays red, the target pixel A12 displays red, the target pixel A21 displays green, and target pixel A22 displays blue. Then the brightness interference value of the target pixel A11 is equal to 5 times ¼. The brightness interference value of the target pixel A12 is equal to 5 times ¼. The brightness interference value of the target pixel A21 is equal to 3 times ¼. The brightness interference value of the target pixel A22 is equal to 4 times ¼.

In step 201, when each target pixel in the target display area is lit up in sequence, the first brightness value of each target pixel collected by the photosensitive sensor may be obtained by using the following step: when each target pixel displays a target color, obtaining the first target brightness value of each target pixel collected by the photosensitive sensor. For example, as shown in FIG. 3, when the target pixel A11 in the first row and the first column displays red, a first target brightness value C11 of the target pixel A11 obtained by the photosensitive sensor is obtained. When the target pixel A12 in the first row and the second column displays red, a first target brightness value C12 of the target pixel A12 obtained by the photosensitive sensor is obtained. By analogy, a first target brightness value Cij of the target pixel Aij in row i and column j is obtained in sequence.

Similarly, when the target pixel A11 displays green, a first target brightness value D11 of the target pixel A11 obtained by the photosensitive sensor is obtained. By analogy, a first target brightness value Dij of the target pixel Aij is obtained. When the target pixel A11 displays green, a first target brightness value E11 of the target pixel A11 obtained by the photosensitive sensor is obtained. By analogy, a first target brightness value Eij of the target pixel Aij is obtained in sequence.

It should be noted that when each target pixel is lit up in sequence, brightness of the screen backlight is set to be the same.

Correspondingly, step 202: According to the first brightness value, obtain a brightness interference value of each target pixel may be implemented by using the following step: according to the first target brightness value, obtaining the brightness interference value of each target pixel. For example, when each target pixel displays a target color (for example, red), a ratio between the first target brightness value and a sum of all the first target brightness values is calculated. The ratio is an interference weight of a target pixel corresponding to the first target brightness value. In a case that each color brightness value corresponding to red is known (the color brightness value may be a brightness value obtained by the photosensitive sensor when all the target pixels are lit up to a certain target color at the same time, or a sum of the obtained brightness values of each target pixel when each target pixel is lit up in sequence. For example, when all the target pixels are lit up to red at the same time, the obtained brightness value collected by the photosensitive sensor is the color brightness value corresponding to red), if the color displayed by A11 is red under the first ambient light, the brightness interference value of A11 is equal to the product of the color brightness value corresponding to red and the interference weight of the target pixel A11. By analogy, the brightness interference value of each target pixel may be calculated and obtained.

Step 203: According to the brightness interference value and the first ambient light brightness value, obtain the target brightness value.

The first ambient light brightness value is a brightness value collected by the photosensitive sensor under the first ambient light.

According to the brightness interference value and the first ambient light brightness value of each target pixel, the target brightness value may be obtained by using the following method: according to the brightness interference value of each target pixel, the first ambient light brightness value is compensated to obtain a compensated first ambient brightness value, and the compensated first ambient light brightness value is taken as the target brightness value. For example, after obtaining the brightness interference value and the first ambient light brightness value of each target pixel, a difference between the first ambient light brightness value and a sum of the brightness interference values of each target pixel may be calculated, and the difference is taken as the target brightness value. Alternatively, the sum of the obtained brightness interference values of each target pixel is multiplied by a preset coefficient to obtain a compensation value. A difference between the first ambient light brightness value and the compensation value is calculated, and the difference is taken as the target brightness value.

The ambient light detection method provided in this embodiment includes: when the target pixel in the target display area of the display module is lit up, obtaining the first brightness value of each target pixel collected by the photosensitive sensor; according to the first brightness value, obtaining the brightness interference value of each target pixel; and according to the brightness interference value and the first ambient light brightness value, obtaining the target brightness value. The target brightness value is obtained according to the brightness interference value and the first ambient light brightness value, thereby improving accuracy of the obtained ambient light brightness value.

Optionally, in step 201, when the target pixels in the target display area of the display module is lit up in sequence, the first brightness value of each target pixel collected by the photosensitive sensor may be obtained by using the following step: when each target pixel displays a target color, obtaining the first target brightness value of each target pixel collected by the photosensitive sensor.

Correspondingly, in step 202, according to the first brightness value, obtaining a brightness interference value of each target pixel may be implemented by using the following step: according to the first target brightness value, obtaining the brightness interference value of each target pixel.

According to the first target brightness value, obtaining a brightness interference value of each target pixel may be implemented by using the following steps:

according to the first target brightness value, determining an interference weight corresponding to each target pixel; and according to the interference weight corresponding to each target pixel, determining a brightness interference value corresponding to each target pixel.

Optionally, in step 201, when each target pixel in the target display area of the display module is lit up in sequence, the first brightness value of each target pixel collected by the photosensitive sensor may be obtained by using the following step: under a second ambient light and when each target pixel is lit up, obtaining a second target brightness value of each target pixel collected by the photosensitive sensor.

Correspondingly, in step 202, according to the first brightness value, obtaining a brightness interference value of each target pixel may be implemented by using the following steps:

according to the second target brightness value, determining the interference weight corresponding to each target pixel; and according to the interference weight corresponding to each target pixel, determining the brightness interference value corresponding to each target pixel.

It should be noted that the ambient light brightness value of the second ambient light may be equal to or not equal to zero. For example, when a second ambient light brightness value corresponding to the second ambient light is equal to zero, the second target brightness value corresponding to each target pixel collected by the photosensitive sensor is obtained. When the ambient light brightness value of the second ambient light is equal to zero, the obtained second target brightness value is not interfered by external ambient light, so that the interference weight corresponding to each target pixel determined according to the second target brightness value is more accurate, so that the determined brightness interference value of each target pixel is more accurate, and the compensation for the first ambient light brightness value is more accurate, thereby further improving accuracy of the target brightness value.

The following exemplarily describes determining the brightness interference value corresponding to each target pixel: an example in which the target area includes only four pixels is used, that is, the maximum value of i is 2 and the maximum value of j is 2. When the target pixel A11 is lit up, the second target brightness value of the target pixel A11 may be obtained. When the target pixel A12 is lit up, the second target brightness value of the target pixel A12 may be obtained. By analogy, When the target pixel A21 is lit, the second target brightness value of the target pixel A21 may be obtained, and when the target pixel A22 is lit up, the second target brightness value of the target pixel A22 may be obtained, then the interference weight corresponding to the target pixel A11 is equal to a ratio of the second target brightness value of the target pixel A11 to a sum of the second target brightness values of each target pixel. Similarly, interference weights corresponding to remaining target pixels can also be calculated, and then the brightness interference value of each target pixel can be calculated according to the interference weight corresponding to each target pixel.

Figure 4:
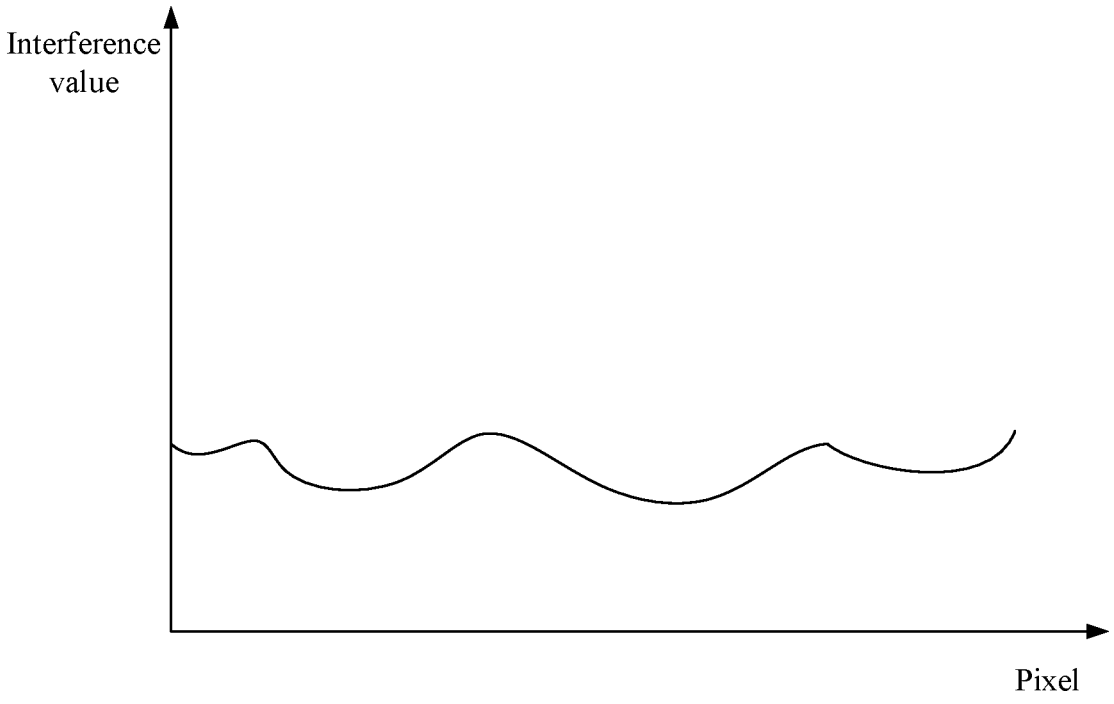
FIG. 4 is a schematic diagram of an interference value generated by a target pixel included in a target area according to an embodiment of the present invention.

For example, under the first ambient light, if the target pixel A11 displays red, an interference value 1 corresponding to the target pixel A11 is equal to the product of a color brightness value corresponding to red and the interference weight corresponding to the target pixel A11. If the target pixel A12 displays green, an interference value 2 corresponding to the target pixel A12 is equal to the product of a color brightness value corresponding to green and the interference weight corresponding to the target pixel A12. If the target pixel A21 displays red, an interference value 3 corresponding to the target pixel A21 is equal to the product of a color brightness value corresponding to red and the interference weight corresponding to the target pixel A21. If the target pixel A22 displays blue, an interference value 4 corresponding to the target pixel A22 is equal to the product of a color brightness value corresponding to blue and the interference weight corresponding to the target pixel A22. As shown in FIG. 4, FIG. 4 is a schematic diagram of an interference value generated by a target pixel included in a target area according to an embodiment of the present invention. The abscissa represents a pixel, and the ordinate represents an interference value corresponding to the pixel.

In this embodiment, according to an interference weight corresponding to each target pixel, a brightness interference value corresponding to each target pixel is obtained. To be specific, an interference weight of each target pixel occupying the target area is considered, so that the obtained interference value may be more accurate, thereby further improving accuracy of a target brightness value.

Optionally, when each target pixel displays a target color, obtaining a first target brightness value of each target pixel collected by a photosensitive sensor may be implemented by using the following step:

under a second ambient light and when each target pixel displays the target color, obtaining a third target brightness value of each target pixel collected by the photosensitive sensor, where the third target brightness value is taken as the first target brightness value.

Correspondingly, according to the first target brightness value, obtaining a brightness interference value of each target pixel may be implemented by using the following steps:

according to the third target brightness value, determining an interference weight corresponding to each target pixel; and according to the interference weight corresponding to each target pixel, determining a brightness interference value corresponding to each target pixel.

It should be noted that the ambient light brightness value of the second ambient light may be equal to or not equal to zero. For example, when the second ambient light brightness value corresponding to the second ambient light is equal to zero and the target pixel displays the target color, the third target brightness value corresponding to each target pixel collected by the photosensitive sensor is obtained. When the ambient light brightness value of the second ambient light is equal to zero, the obtained third target brightness value is not interfered by external ambient light, so that the interference weight corresponding to each target pixel determined according to the third target brightness value is more accurate, so that the determined brightness interference value of each target pixel is more accurate, and the compensation for the first ambient light brightness value is more accurate, thereby further improving accuracy of the target brightness value.

The following exemplarily describes determining the brightness interference value corresponding to each target pixel: using an example in which the target area includes only four pixels, and using the first target brightness value Cij described by the example in the foregoing embodiment as the obtained third target brightness value of the target pixel Aij collected by the photosensitive sensor under the second ambient light and when each target pixel displays the target color (red), using the first target brightness value Dij as the obtained third target brightness value of the target pixel Aij collected by the photosensitive sensor under the second ambient light and when each target pixel displays the target color (green), using the first target brightness value Eij as the obtained third target brightness value of the target pixel Aij collected by the photosensitive sensor under the second ambient light and when each target pixel displays the target color (blue); using an example in which the maximum value of i is 2 and the maximum value of j is 2, when each target pixel displays red, the interference weight G11 corresponding to the target pixel $$A11 = \frac{C11}{C11 + C12 + C21 + C22},$$

the interference weight G12 corresponding to the target pixel $$A12 = \frac{C12}{C11 + C12 + C21 + C22},$$

and by analogy, the interference weight G21 corresponding to the target pixel A21 and the interference weight G22 corresponding to the target pixel A22 may be determined.

Similarly, with reference to the foregoing exemplary description, when the target pixel displays green, an interference weight Hij corresponding to each target pixel is obtained. When the target pixel displays blue, the interference weight Kij corresponding to each target pixel is obtained.

According to the corresponding interference weight when each target pixel displays the target color, the interference weight corresponding to each target pixel may be determined under the first ambient light and when each target pixel displays one of the target colors. For example, under the first ambient light, if the target pixel A11 displays red, the interference weight corresponding to the target pixel A11 is equal to G11, and the interference value 1 is equal to the product of the color brightness value corresponding to red and the interference weight G11. If the target pixel A12 displays green, the interference weight corresponding to the target pixel A12 is equal to H12, and the interference value 2 corresponding to the target pixel A12 is equal to the product of the color brightness value corresponding to green and H12. If the target pixel A21 displays red, the interference weight corresponding to the target pixel A21 is equal to G21, and the interference value 3 corresponding to the target pixel A21 is equal to the product of the color brightness value corresponding to red and G21. If the target pixel A22 displays blue, the interference weight corresponding to the target pixel A22 is equal to K22, and the interference value 4 corresponding to the target pixel A22 is equal to the product of the color brightness value corresponding to blue and K22. As shown in FIG. 4, FIG. 4 is a schematic diagram of an interference value generated by a target pixel included in a target area according to an embodiment of the present invention. The abscissa represents a pixel, and the ordinate represents an interference value corresponding to the pixel.

In this embodiment, according to an interference weight corresponding to each target pixel, a brightness interference value corresponding to each target pixel is obtained. To be specific, the interference weight of each target pixel occupying the target area is considered, and the determined interference weight corresponding to the target pixel corresponds to the target color, to be specific, when the target pixel displays a certain target color under the first ambient light, the interference weight corresponding to the target pixel is determined in this certain target color, so that the obtained interference value can be more accurate, thereby further improving accuracy of the target brightness value.

Figure 5:
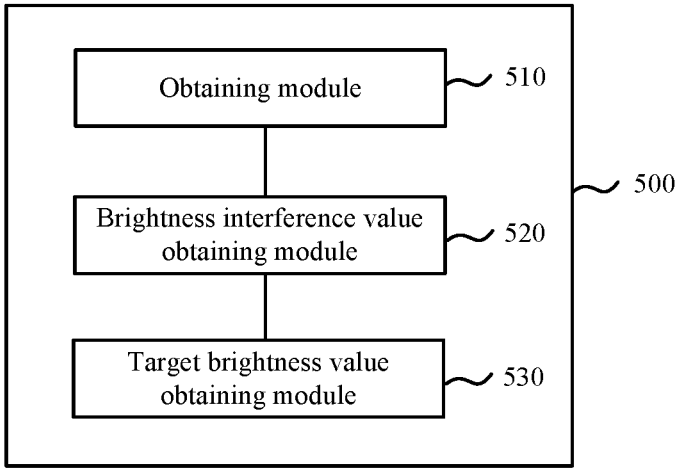
FIG. 5 is a structural block diagram of an electronic device according to an embodiment of the present invention.

As shown in FIG. 5, FIG. 5 is a structural block diagram of an electronic device according to an embodiment of the present invention. The electronic device includes a photosensitive sensor, and a glass cover and a display module that are stacked in sequence, where the photosensitive sensor is disposed on a side of the display module away from the glass cover. The electronic device in this embodiment of the present invention can implement details of the ambient light detection method in the foregoing embodiment, with the same technical effects achieved. The electronic device 500 as shown in FIG. 5 includes:

an obtaining module 510, configured to, when a target pixel in a target display area of the display module is lit up, obtain a first brightness value of each target pixel collected by the photosensitive sensor;

a brightness interference value obtaining module 520, configured to, according to the first brightness value, obtain a brightness interference value of each target pixel; and a target brightness value obtaining module 530, configured to, according to the brightness interference value and a first ambient light brightness value, obtain a target brightness value, where the first ambient light brightness value is a brightness value collected by the photosensitive sensor under a first ambient light.

According to the electronic device provided in this embodiment, when a target pixel in a target display area of the display module is lit up, a first brightness value of each target pixel collected by a photosensitive sensor is obtained; according to the first brightness value, a brightness interference value of each target pixel is obtained; and according to the brightness interference value and a first ambient light brightness value, a target brightness value is obtained. The target brightness value is obtained according to the brightness interference value and the first ambient light brightness value, thereby improving accuracy of the obtained ambient light brightness value.

Optionally, the obtaining module 510 is specifically configured to, when each target pixel displays a target color, obtain a first target brightness value of each target pixel collected by the photosensitive sensor.

The brightness interference value obtaining module 520 is configured to, according to the first target brightness value, obtain the brightness interference value of each target pixel.

Optionally, the brightness interference value obtaining module 520 is specifically configured to, according to the first target brightness value, determine an interference weight corresponding to each target pixel; and according to the interference weight corresponding to each target pixel, determine a brightness interference value corresponding to each target pixel.

The obtaining module 510 is configured to, under a second ambient light and when each target pixel is lit up, obtain a second target brightness value of each target pixel collected by the photosensitive sensor.

The brightness interference value obtaining module 520 is specifically configured to, according to the second target brightness value, determine an interference weight corresponding to each target pixel; and according to the interference weight corresponding to each target pixel, determine a brightness interference value corresponding to each target pixel.

Optionally, the obtaining module 510 is specifically configured to, under the second ambient light and when each target pixel displays the target color, obtain a third target brightness value of each target pixel collected by the photosensitive sensor.

The brightness interference value obtaining module 520 is specifically configured to, according to the third target brightness value, determine an interference weight corresponding to each target pixel; and according to the interference weight corresponding to each target pixel, determine a brightness interference value corresponding to each target pixel.

Figure 6:
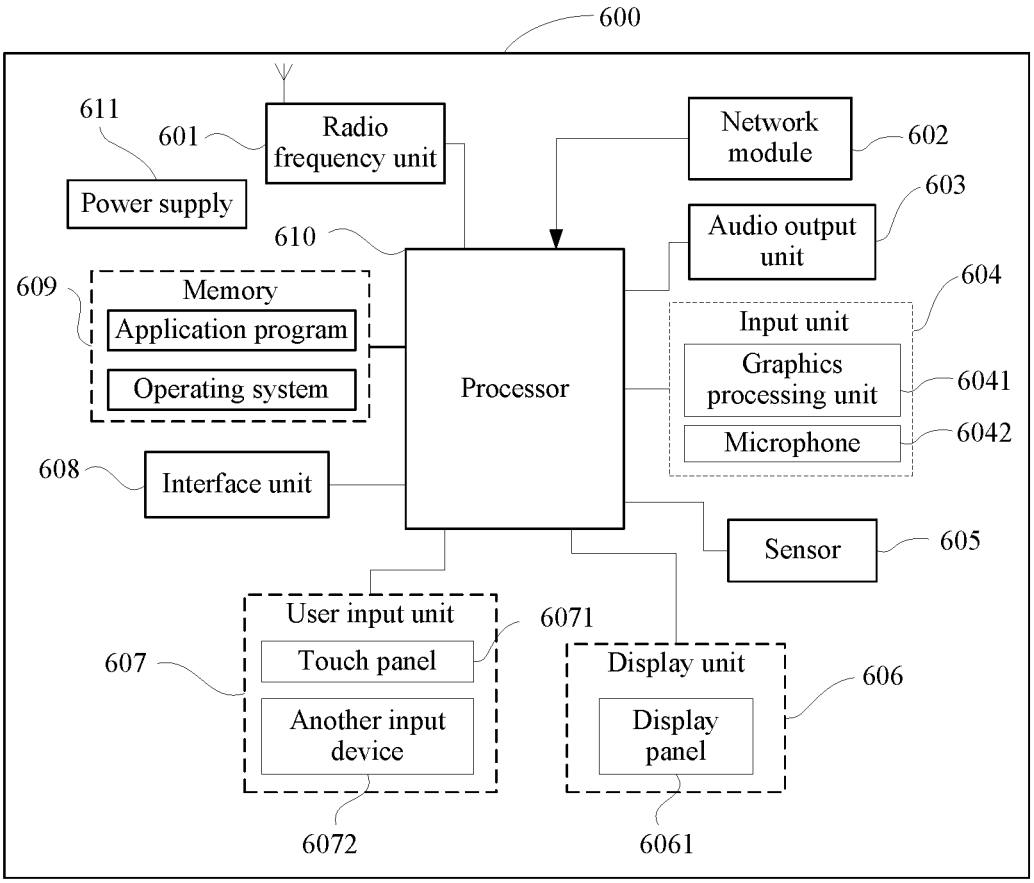
FIG. 6 is a schematic diagram of a hardware structure of an electronic device according to an embodiment of the present invention.

FIG. 6 is a schematic diagram of a hardware structure of an electronic device according to an embodiment of the present invention. The electronic device 600 includes but is not limited to components such as a radio frequency unit 601, a network module 602, an audio output unit 603, an input unit 604, a sensor 605, a display unit 606, a user input unit 607, an interface unit 608, a memory 609, a processor 610, and a power supply 611. A person skilled in the art may understand that a structure of the electronic device shown in FIG. 6 constitutes no limitation on the electronic device, and the electronic device may include more or fewer components than those shown in the figure, or have a combination of some components, or have a different component arrangement. In this embodiment of the present invention, the electronic device includes but is not limited to a mobile phone, a tablet computer, a notebook computer, a palmtop computer, an in-vehicle terminal, a wearable device, a pedometer, and the like.

The electronic device further includes a photosensitive sensor, and a glass cover and a display module that are stacked in sequence, where the photosensitive sensor is disposed on a side of the display module away from the glass cover.

The processor 610 is configured to, when a target pixel in a target display area of a display module is lit up, obtain a first brightness value of each target pixel collected by a photosensitive sensor; according to the first brightness value, obtain a brightness interference value of each target pixel; and according to the brightness interference value and a first ambient light brightness value, obtain a target brightness value.

In this embodiment of the present invention, when a target pixel in a target display area of a display module is lit up, a first brightness value of each target pixel collected by a photosensitive sensor is obtained; according to the first brightness value, a brightness interference value of each target pixel is obtained; and according to the brightness interference value and a first ambient light brightness value, a target brightness value is obtained. The target brightness value is obtained according to the brightness interference value and the first ambient light brightness value, thereby improving accuracy of the obtained ambient light brightness value.

It should be understood that, in this embodiment of the present invention, the radio frequency unit 601 may be configured to receive and send information or a signal in a call process. Specifically, after receiving downlink data from a base station, the radio frequency unit sends the downlink data to the processor 610 for processing. In addition, the radio frequency unit sends uplink data to the base station. Generally, the radio frequency unit 601 includes but is not limited to: an antenna, at least one amplifier, a transceiver, a coupler, a low noise amplifier, a duplexer, and the like. In addition, the radio frequency unit 601 may communicate with a network and another device through a wireless communication system.

The electronic device provides users with wireless broadband Internet access through the network module 602, for example, helps users receive and send e-mails, browse web pages, and access streaming media.

The audio output unit 603 may convert audio data received by the radio frequency unit 601 or the network module 602 or stored in the memory 609 into an audio signal and output the audio signal as sound. Moreover, the audio output unit 603 can further provide audio output related to a specific function performed by the electronic device 600 (for example, call signal received sound and message received sound). The audio output unit 603 includes a speaker, a buzzer, a telephone receiver, and the like.

The input unit 604 is configured to receive an audio signal or a video signal. The input unit 604 may include a graphics processing unit (GPU) 6041 and a microphone 6042. The graphics processing unit 6041 processes image data of a static image or video obtained by an image capture apparatus (such as, a camera) in a video capture mode or an image capture mode. A processed image frame may be displayed on the display unit 606. The image frame processed by the graphics processing unit 6041 may be stored in the memory 609 (or another storage medium) or sent by using the radio frequency unit 601 or the network module 602. The microphone 6042 may receive sound and can process such sound into audio data. Processed audio data may be converted, in a call mode, into a format that can be sent to a mobile communication base station by using the radio frequency unit 601 for output.

The electronic device 600 further includes at least one sensor 605, for example, a light sensor, a motion sensor, and another sensor. Specifically, an optical sensor includes a photosensitive sensor and a proximity sensor. The photosensitive sensor may adjust brightness of a display panel 6061 according to brightness of ambient light. The proximity sensor may turn off and/or backlight of the display panel 6061 when the electronic device 600 moves to an ear. As a type of the motion sensor, an accelerometer sensor may detect an acceleration value in each direction (generally, three axes), and detect a value and a direction of gravity when the accelerometer sensor is static, and may be used for recognizing a posture of the electronic device (such as screen switching between landscape and portrait modes, a related game, or magnetometer posture calibration), a function related to vibration recognition (such as a pedometer or a knock), and the like. The sensor 605 may further include a fingerprint sensor, a pressure sensor, an iris sensor, a molecular sensor, a gyroscope, a barometer, a hygrometer, a thermometer, an infrared sensor, and the like. Details are not described herein.

The display unit 606 is configured to display information entered by a user or information provided for a user. The display unit 606 may include a display panel 6061. The display panel 6061 may be configured in a form of a liquid crystal display (Liquid Crystal Display, LCD), an organic light-emitting diode (Organic Light-Emitting Diode, OLED), or the like.

The user input unit 607 may be configured to: receive input digital or character information, and generate key signal input related to a user setting and function control of the electronic device. Specifically, the user input unit 607 includes a touch panel 6071 and another input device 6072. The touch panel 6071, also called a touch screen, may collect touch operation on or near the touch panel by users (for example, operation on the touch panel 6071 or near the touch panel 6071 by fingers or any suitable objects or accessories such as a touch pen by the users). The touch panel 6071 may include two parts: a touch detection apparatus and a touch controller. The touch detection apparatus detects a touch location of the user, detects a signal brought by the touch operation, and sends the signal to the touch controller. The touch controller receives touch information from the touch detection apparatus, converts the touch information into touch point coordinates, sends the touch point coordinates to the processor 610, and receives and executes a command sent by the processor 610. In addition, the touch panel 6071 may be implemented in various types such as a resistor, a capacitor, an infrared ray, or a surface acoustic wave. The user input unit 607 may further include another input device 6072 in addition to the touch panel 6071. Specifically, the another input device 6072 may include but is not limited to a physical keyboard, a functional button (such as a volume control button or a power on/off button), a trackball, a mouse, and a joystick. Details are not described herein.

Further, the touch panel 6071 may cover the display panel 6061. When detecting the touch operation on or near the touch panel 6071, the touch panel transmits the touch operation to the processor 610 to determine a type of a touch event, and then the processor 610 provides corresponding visual output on the display panel 6061 according to the type of the touch event. Although the touch panel 6071 and the display panel 6061 are used as two separate components to implement input and output functions of the terminal device in FIG. 6, the touch panel 6071 and the display panel 6061 may be integrated to implement the input and output functions of the terminal device in some embodiments. This is not specifically limited herein.

The interface unit 608 is an interface for connecting an external apparatus with the electronic device 600. For example, the external apparatus may include a wired or wireless headset jack, an external power supply (or a battery charger) port, a wired or wireless data port, a storage card port, a port for connecting an apparatus having an identification module, an audio input/output (I/O) port, a video I/O port, a headset jack, or the like. The interface unit 606 may be configured to receive an input (for example, data information and power) from an external apparatus and transmit the received input to one or more elements in the electronic device 600, or may be configured to transmit data between the electronic device 600 and the external apparatus.

The memory 609 may be configured to store a software program and various pieces of data. The memory 609 may mainly include a program storage region and a data storage region. The program storage region may store an operating system, an application required by at least one function (such as a sound play function or an image play function), and the like. The data storage region may store data (such as audio data or an address book) created according to use of the mobile phone, and the like. In addition, the memory 609 may include a high-speed random access memory, and may further include a nonvolatile memory, for example, at least one magnetic disk storage device, a flash storage device, or another volatile solid-state storage device.

The processor 610 is a control center of the electronic device, connects all parts of the entire electronic device by using various interfaces and lines, and performs various functions of the electronic device and data processing by running or executing a software program and/or a module that are/is stored in the memory 609 and by invoking data stored in the memory 609, to overall monitor the electronic device. The processor 610 may include one or more processing units. Preferably, an application processor and a modem processor may be integrated into the processor 610. The application processor mainly processes an operating system, a user interface, an application, and the like. The modem processor mainly processes wireless communications. It can be understood that, alternatively, the modem processor may not be integrated into the processor 610.

The electronic device 600 may further include the power supply 611 (for example, a battery) supplying power to each component. Preferably, the power supply 611 may be logically connected to the processor 610 by using a power management system, so as to implement functions such as charging management, discharging management, and power consumption management by using the power management system.

In addition, the electronic device 600 includes some function modules not shown. Details are not described herein.

Optionally, an embodiment of the present invention further provides an electronic device, including a processor 610, a memory 609, and a computer program stored in the memory 609 and capable of running on the processor 610. When the computer program is executed by the processor 610, the processes of the foregoing ambient light detection method embodiment are implemented, with the same technical effects achieved. To avoid repetition, details are not described herein again.

An embodiment of the present invention further provides an electronic device, configured to implement processes of the foregoing ambient light detection method embodiment, with a same technical effect achieved. Therefore, details are not described herein again to avoid repetition.

An embodiment of the present invention further provides a computer-readable storage medium, where the computer-readable storage medium stores a computer program, and when the computer program is executed by a processor, the processes of the foregoing ambient light detection method embodiment may be implemented, with the same technical effects achieved. To avoid repetition, details are not described herein again. For example, the computer-readable storage medium includes a non-transitory computer-readable storage medium, such as a read-only memory (Read-Only Memory, ROM for short), a random access memory (Random Access Memory, RAM for short), a magnetic disk, an optical disc, or the like.

An embodiment of the present invention further provides a computer program product. The computer program product may be executed by a processor to implement processes of the foregoing ambient light detection method embodiment, with a same technical effect achieved. Therefore, details are not described herein again to avoid repetition.

It should be noted that, in this specification, the terms "include", "comprise", or their any other variant is intended to cover a non-exclusive inclusion, so that a process, a method, an article, or an apparatus that includes a list of elements not only includes those elements but also includes other elements which are not expressly listed, or further includes elements inherent to such process, method, article, or apparatus. In the absence of more restrictions, an element defined by the statement "including a . . . " does not preclude the presence of other identical elements in the process, method, article, or apparatus that includes the element.

According to the descriptions of the foregoing implementation manners, a person skilled in the art may clearly understand that the method in the foregoing embodiment may be implemented by software in addition to a necessary universal hardware platform or by hardware only. In most circumstances, the former is a preferred implementation manner. According to such an understanding, the technical solutions of the present invention essentially or the part contributing to the prior art may be implemented in a form of a software product. The computer software product is stored in a storage medium (such as a ROM/RAM, a hard disk, or an optical disc), and includes several instructions for instructing a terminal (which may be mobile phone, a computer, a server, an air conditioner, a network device, or the like) to perform the methods described in the embodiments of the present invention.

The embodiments of the present invention are described above with reference to the accompanying drawings, but the present invention is not limited to the above specific implementations, and the above specific implementations are only illustrative and not restrictive. Under the enlightenment of the present invention, those of ordinary skill in the art can make many forms without departing from the purpose of the present invention and the protection scope of the claims, all of which fall within the protection of the present invention.

What is claimed is:

1. An ambient light detection method, applied to an electronic device, wherein the electronic device comprises a photosensitive sensor, and a glass cover and a display module that are stacked in sequence, wherein the photosensitive sensor is disposed on a side of the display module away from the glass cover, and the method comprises:

when a target pixel in a target display area of the display module is lit up, obtaining a first brightness value of each target pixel collected by the photosensitive sensor;

obtaining a brightness interference value of each target pixel according to the first luminance value; and according to the brightness interference value and a first ambient light brightness value, obtaining a target brightness value, wherein the first ambient light brightness value is a brightness value collected by the photosensitive sensor under a first ambient light;

wherein the obtaining the first brightness value of each target pixel collected by the photosensitive sensor when the target pixel in the target display area of the display module is lit up comprises:

when there exist a plurality of target pixels in the target display area and the target pixels in the target display area are lit up in sequence, obtaining the first brightness value of each of the target pixels collected by the photosensitive sensor.

2. The method according to claim 1, wherein that when a target pixel in a target display area of the display module is lit up, obtaining a first brightness value of each target pixel collected by the photosensitive sensor comprises:

when each target pixel displays a target color, obtaining a first target brightness value of each target pixel collected by the photosensitive sensor; and that according to the first brightness value, obtaining a brightness interference value of each target pixel comprises:

according to the first target brightness value, obtaining the brightness interference value of each target pixel.

3. The method according to claim 2, wherein that according to the first target brightness value, obtaining the brightness interference value of each target pixel comprises:

according to the first target brightness value, determining an interference weight corresponding to each target pixel; and according to the interference weight corresponding to each target pixel, determining a brightness interference value corresponding to each target pixel.

4. The method according to claim 1, wherein that when a target pixel in a target display area of the display module is lit up, obtaining a first brightness value of each target pixel collected by the photosensitive sensor comprises:

under a second ambient light and when each target pixel is lit up, obtaining a second target brightness value of each target pixel collected by the photosensitive sensor; and that according to the first brightness value, obtaining a brightness interference value of each target pixel comprises:

according to the second target brightness value, determining the interference weight corresponding to each target pixel; and according to the interference weight corresponding to each target pixel, determining a brightness interference value corresponding to each target pixel.

5. The method according to claim 2, wherein that when each target pixel displays a target color, obtaining a first target brightness value of each target pixel collected by the photosensitive sensor comprises:

under a second ambient light and when each target pixel displays the target color, obtaining a third target brightness value of each target pixel collected by the photosensitive sensor; and that according to the first target brightness value, obtaining the brightness interference value of each target pixel comprises:

according to the third target brightness value, determining an interference weight corresponding to each target pixel; and according to the interference weight corresponding to each target pixel, determining a brightness interference value corresponding to each target pixel.

6. An electronic device, comprising: a memory, a processor and a computer program stored in the memory and executable by the processor, wherein the processor executes the computer program to:

when a target pixel in a target display area of a display module comprised by the electronic device is lit up, obtain a first brightness value of each target pixel collected by a photosensitive sensor;

according to the first brightness value, obtain a brightness interference value of each target pixel; and according to the brightness interference value and a first ambient light brightness value, obtain a target brightness value, wherein the first ambient light brightness value is a brightness value collected by the photosensitive sensor under a first ambient light;

wherein the processor executes the computer program to:

when there exist a plurality of target pixels in the target display area and the target pixels in the target display area are lit up in sequence, obtain the first brightness value of each of the target pixels collected by the photosensitive sensor.

7. The electronic device according to claim 6, wherein the processor executes the computer program to: when each target pixel displays a target color, obtain a first target brightness value of each target pixel collected by the photosensitive sensor; and according to the first target brightness value, obtain the brightness interference value of each target pixel.

8. The electronic device according to claim 7, wherein the processor executes the computer program to: according to the first target brightness value, determine an interference weight corresponding to each target pixel; and according to the interference weight corresponding to each target pixel, determine the brightness interference value corresponding to each target pixel.

9. The electronic device according to claim 6, wherein the processor executes the computer program to: under a second ambient light and when each target pixel is lit up, obtain a second target brightness value of each target pixel collected by the photosensitive sensor; and according to the second target brightness value, determine an interference weight corresponding to each target pixel; and according to the interference weight corresponding to each target pixel, determine a brightness interference value corresponding to each target pixel.

10. The method according to claim 7, wherein the processor executes the computer program to: under a second ambient light and when each target pixel displays the target color, obtain a third target brightness value of each target pixel collected by the photosensitive sensor: and according to the third target brightness value, determine an interference weight corresponding to each target pixel; and according to the interference weight corresponding to each target pixel, determine a brightness interference value corresponding to each target pixel.

11. A non-transitory computer-readable storage medium, wherein the non-transitory computer-readable storage medium stores a computer program, the processor executes the computer program to:

when a target pixel in a target display area of the display module is lit up, obtain a first brightness value of each target pixel collected by the photosensitive sensor;

obtain a brightness interference value of each target pixel according to the first luminance value; and according to the brightness interference value and a first ambient light brightness value, obtain a target brightness value, wherein the first ambient light brightness value is a brightness value collected by the photosensitive sensor under a first ambient light;

wherein the processor executes the computer program to:

when there exist a plurality of target pixels in the target display area and the target pixels in the target display area are lit up in sequence, obtain the first brightness value of each of the target pixels collected by the photosensitive sensor.

12. The non-transitory computer-readable storage medium according to claim 11, wherein the processor executes the computer program to:

when each target pixel displays a target color, obtain a first target brightness value of each target pixel collected by the photosensitive sensor; and the processor executes the computer program to:

according to the first target brightness value, obtain the brightness interference value of each target pixel.

13. The non-transitory computer-readable storage medium according to claim 12, wherein the processor executes the computer program to:

according to the first target brightness value, determine an interference weight corresponding to each target pixel; and according to the interference weight corresponding to each target pixel, determine a brightness interference value corresponding to each target pixel.

14. The non-transitory computer-readable storage medium according to claim 11, wherein the processor executes the computer program to:

under a second ambient light and when each target pixel is lit up, obtain a second target brightness value of each target pixel collected by the photosensitive sensor; and the processor executes the computer program to:

according to the second target brightness value, determine the interference weight corresponding to each target pixel; and according to the interference weight corresponding to each target pixel, determine a brightness interference value corresponding to each target pixel.

15. The non-transitory computer-readable storage medium according to claim 12, wherein the processor executes the computer program to:

under a second ambient light and when each target pixel displays the target color, obtain a third target brightness value of each target pixel collected by the photosensitive sensor; and the processor executes the computer program to:

according to the third target brightness value, determine an interference weight corresponding to each target pixel; and according to the interference weight corresponding to each target pixel, determine a brightness interference value corresponding to each target pixel.

* * * * *